US008670008B2

(12) United States Patent
Park

(10) Patent No.: US 8,670,008 B2
(45) Date of Patent: Mar. 11, 2014

(54) ORGANIC LIGHT EMITTING DISPLAY DEVICE AND DRIVING METHOD THEREOF

(75) Inventor: Kyong-Tae Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 445 days.

(21) Appl. No.: 13/010,740

(22) Filed: Jan. 20, 2011

(65) Prior Publication Data

US 2011/0267376 A1 Nov. 3, 2011

(30) Foreign Application Priority Data

May 3, 2010 (KR) ..... 10-2010-0041392

(51) Int. Cl.
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS 7,139,008 B2 * 11/2006 Mori et al. ..... 345/690
2008/0246699 A1 * 10/2008 Oh ..... 345/76
2008/0284767 A1 * 11/2008 Mori et al. ..... 345/207

FOREIGN PATENT DOCUMENTS

KR 10 2005 0036655 A 4/2005
KR 10 2006 0014797 A 2/2006
KR 10-2010-0031003 A 3/2010

OTHER PUBLICATIONS

KIPO Office Action dated Apr. 18, 2012 for Korean priority Patent application No. 10-2010-0041392 (1 page).
KIPO Office Action dated Oct. 13, 2011 for KR Application No. 10-2010-0041392 (3 pages).

* cited by examiner

*Primary Examiner* — Quna-Zhen Wang
*Assistant Examiner* — Nelson D Runkle, III
(74) *Attorney, Agent, or Firm* — Christie, Parker & Hale, LLP

(57) ABSTRACT

An organic light emitting display device includes: pixels connected to corresponding scanning lines and corresponding data lines; a scanning driver for supplying scanning signals to the scanning lines; a data driver for supplying data signals to the data lines; and a data processor for generating a luminance look-up table corresponding to a likelihood of burn-in for the pixels, for generating output data from input data corresponding to the look-up table, and for supplying the output data to the data driver.

27 Claims, 4 Drawing Sheets

ORGANIC LIGHT EMITTING DISPLAY DEVICE AND DRIVING METHOD THEREOF

CROSS-REFERENCE TO RELATED APPLICATIONS

This application claims priority to and the benefit of Korean Patent Application No. 10-2010-0041392, filed on May 3, 2010, in the Korean Intellectual Property Office, the entire content of which is incorporated herein by reference.

BACKGROUND

1. Field

The following description relates to an organic light emitting display device having improved image quality, and a driving method of the organic light emitting display device.

2. Discussion of Related Art

A variety of flat panel displays have been developed that improve upon aspects of cathode ray tubes, including reduced weight and size. Among these flat panel displays are liquid crystal displays, a field emission displays, plasma display panels, and organic light emitting display devices, among others.

Among these, the organic light emitting display device displays an image using organic light emitting diodes that emit light by recombining electrons and holes. The organic light emitting display device has fast response times and is driven with low power consumption.

In general, organic light emitting display devices are classified as either a passive matrix type (PMOLED) or an active matrix type (AMOLED), in accordance with the driving of the organic light emitting diodes.

The active matrix type organic light emitting display device includes a plurality of scanning lines, a plurality of data lines, a plurality of power source lines, and a plurality of pixels connected with the lines and arranged in a matrix. The pixel commonly includes an organic light emitting diode, a driving transistor controlling the amount of current supplied to the organic light emitting diode, a switching transistor transmitting a data signal to the driving transistor, and a storage capacitor maintaining a voltage of the data signal.

The range of applications of the organic light emitting display device has expanded to various devices, including portable devices. However, it is more difficult to implement organic light emitting display devices in laptops, etc., due to image burn-in. In detail, computers using a common O/S (e.g. Windows) consistently display the same image (e.g., a retention image) in a predetermined region, such that pixel burn-in rapidly occurs in some regions.

Screen savers that turn off screens or play various videos have been developed to overcome or reduce burn-in. However, screen savers stop information transmission, in other words, the primary function of displays.

SUMMARY OF THE INVENTION

Embodiments of the present invention provide an organic light emitting display device that can minimize or reduce image burn-in, and a driving method for such an organic light emitting display device.

According to an embodiment of the present invention, there is provided an organic light emitting display device that includes: pixels connected to corresponding scanning lines and corresponding data lines; a scanning driver for supplying scanning signals to the scanning lines; a data driver for supplying data signals to the data lines; and a data processor for generating a luminance look-up table corresponding to a likelihood of burn-in for the pixels, for generating output data from input data corresponding to the look-up table, and for supplying the output data to the data driver.

The data processor may include: a frame memory for storing the input data; a data comparer for generating comparison values by comparing previous input data stored in the frame memory with current input data supplied from the outside; a control value generator for generating a first control value and a second control value corresponding to the comparison values; a look-up table generator for generating the luminance look-up table corresponding to the first control value and the second control value; and a luminance controller for generating the output data corresponding to the luminance look-up table. The data comparer may be configured to increase the comparison value when the current input data is larger than a first reference value or when an absolute value obtained by subtracting the previous input data from the current input data is smaller than a second reference value. The control value generator may include: a first control value generator for generating the first control value by utilizing the comparison values for substantially all of the pixels; a second control value generator for generating a second control value by utilizing comparison values for pixels corresponding to outer regions of the display device; and a resetter for initializing the first control value and the second control value when a reset signal is received from the data comparer. The look-up table generator may include: a basic look-up table for providing first burn-in values having a value between 1 and 0 corresponding to the likelihood of burn-in corresponding to a position of the pixels in the display device; a multiplier for generating second burn-in values by multiplying the first burn-in values stored in the look-up table by the second control value; and a subtractor for generating third burn-in values by subtracting the second burn-in values from the first control value.

According to another embodiment of the present invention, there is provided a method of driving an organic light emitting display device, which includes: comparing previous input data with current input data; increasing a comparison value when the previous input data is larger than a first reference value or when an absolute value obtained by subtracting the previous input data from the current input data is smaller than a second reference value; generating a first control value by utilizing the comparison values for substantially all of the pixels of the display device; generating a second control value by utilizing the comparison values for pixels corresponding to outer regions of the display device; generating a luminance look-up table by utilizing a basic look-up table including first burn-in values between 1 and 0, corresponding to a likelihood of burn-in corresponding to a position of the pixels in the display device, the first control value, and the second control value; and generating output data by changing the current input data utilizing the luminance look-up table.

The first control value may be reduced when the comparison values for substantially all of the pixels are greater than half of a comparison value range. The second control value may be reduced when the comparison values of the pixels corresponding to the outer regions of the display device are greater than half of a comparison value range.

The generating of the luminance look-up table may include: generating second burn-in values by multiplying the first burn-in values stored in the basic look-up table with the second control value; generating third burn-in values by subtracting the second burn-in values from the first control value; and generating the luminance look-up table with the third burn-in values. The output data corresponding to one of the pixels is generated by multiplying the third burn-in value corresponding to the one of the pixels with the input data corresponding to the one of the pixels.

According to the organic light emitting display device and a driving method of the organic light emitting display device of embodiments of the present invention, burn-in can be minimized or reduced by reducing the luminance in region where burn-in more easily or is more likely to occur. Further, since the luminance of regions where burn-in does not occur or occurs more frequently maintains a luminance level similar to the initial or intended luminance, burn-in can be prevented or reduced without reducing the image quality. Further, in embodiments of the present invention, changes in luminance cannot be recognized or may be less recognizable by a user, by for example, controlling the luminance to change at 1 to 0.5 nit/sec.

BRIEF DESCRIPTION OF THE DRAWINGS

The accompanying drawings, together with the specification illustrate exemplary embodiments of the present invention, and, together with the description, serve to explain the principles of the present invention.

DETAILED DESCRIPTION OF EXEMPLARY EMBODIMENTS

Figure 1:
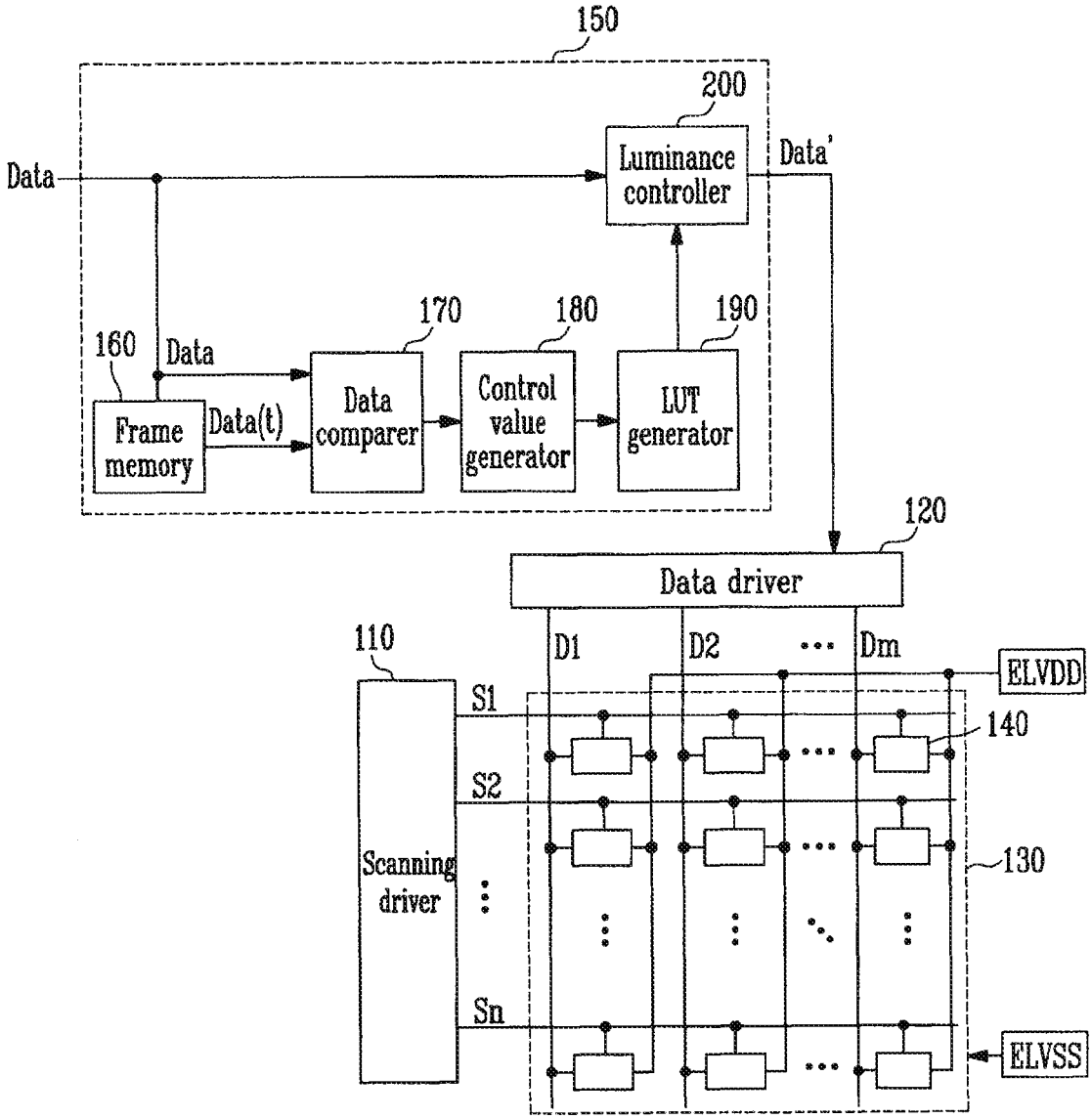
FIG. 1 is a schematic diagram illustrating an organic light emitting display device according to an embodiment of the present invention.

In the following detailed description, only certain exemplary embodiments of the present invention have been shown and described by way of illustration. As those skilled in the art will recognize, the described embodiments may be modified in various different ways without departing from the spirit or scope of the present invention. Accordingly, the drawings and description are to be regarded as illustrative in nature, and not restrictive. In addition, when an element is referred to as being "on" another element, it can either be directly on the other element, or can be indirectly on the other element, with one or more elements interposed therebetween. Also, when an element is referred to as being "connected to" another element, it can either be directly connected to the other element, or can be indirectly connected to the other element, with one or more elements interposed therebetween. Hereinafter, like reference numerals refer to like elements.

Exemplary embodiments for those skilled in the art to implement the present invention are described in detail with reference to FIGS. 1 to 6.

FIG. 1 is a diagram illustrating an organic light emitting display device according to an embodiment of the present invention.

Referring to FIG. 1, an organic light emitting display device according to an embodiment of the present invention includes: a display region 130 including pixels 140 connected to scanning lines S1 to Sn and data lines D1 to Dm; a scanning driver 110 for supplying scanning signals to the scanning lines S1 to Sn; a data driver for supplying data signals to the data lines D1 to Dm; and a data processor 150 for generating output data Data' by changing bits of input data to minimize or reduce image burn-in.

The scanning driver 110 sequentially supplies scanning signals to the scanning lines S1 to Sn.

The data driver 120 generates data signals, using the output data Data' and supplies the generated data signals to the data lines D1 to Dm in synchronization with the scanning lines.

The display region 130 has pixels 140 positioned at the crossing regions of the scanning lines S1 to Sn and the data lines D1 to Dm. The pixels 140 are selected according to horizontal line, and receive data signals when the scanning signals are supplied. The pixels 140 control an amount of current supplied through organic light emitting diodes to a second power source ELVSS from a first power source ELVDD in response to the data signals. Accordingly, light having luminance (e.g., a predetermined luminance) is generated in the organic light emitting diode.

The data processor 150 generates the output data Data' by changing the input data to minimize image burn-in and transmits the generated output data Data' to the data driver 120. In one embodiment, the data processor 150 has a frame memory 160, a data comparer 170, a control value generator 180, an LUT generator 190, and a luminance controller 200.

The frame memory 160 stores data for one frame or a portion of data of one frame. The frame memory 160 is used to store previous data to check a retention image. Here, 100% accurate distinction of a retention image display area may not be as significant, since in some embodiments only a portion of data of one frame may be stored in the frame memory 160.

The data comparer 170 compares the current data (e.g., data of a current frame) with previous data(t) (e.g., data from a previous frame) and generates a comparison value corresponding to the compared result. For example, the data comparer 170 may compare the previous data with the current data, and reduce the comparison value when determining that video has changed, or for example, that a luminance has changed in a certain way.

The control value generator 180 receives comparison values from the data comparer 170 and generates control values, using the received comparison values. For example, the control value generator 180 may generate a first control value using the comparison values for all pixels, and may generate a second control value using the comparison values for pixels outside a panel.

The look-up table (hereafter, referred to as 'LUT') generator 190 may generate a luminance LUT using the first control value, the second control value, and a basic LUT that may be previously stored. The luminance LUT is generated by the first control value and the second control value and includes information on each pixel to minimize or reduce burn-in.

The luminance controller 200 generates the output data Data' by controlling the luminance of the input data by utilizing the luminance LUT. For example, the luminance controller 200 can adjust input data to be supplied to a particular pixel, and output corresponding data Data' by multiplying a burn-in value extracted from the LUT corresponding to the particular pixel. In this case, the output data Data' is generated such that the luminance of portions where burn-in may more easily occur becomes lower, and accordingly, embodiments of the present invention may more effectively serve to minimize or reduce image burn-in without stopping information transmission.

Figure 2:
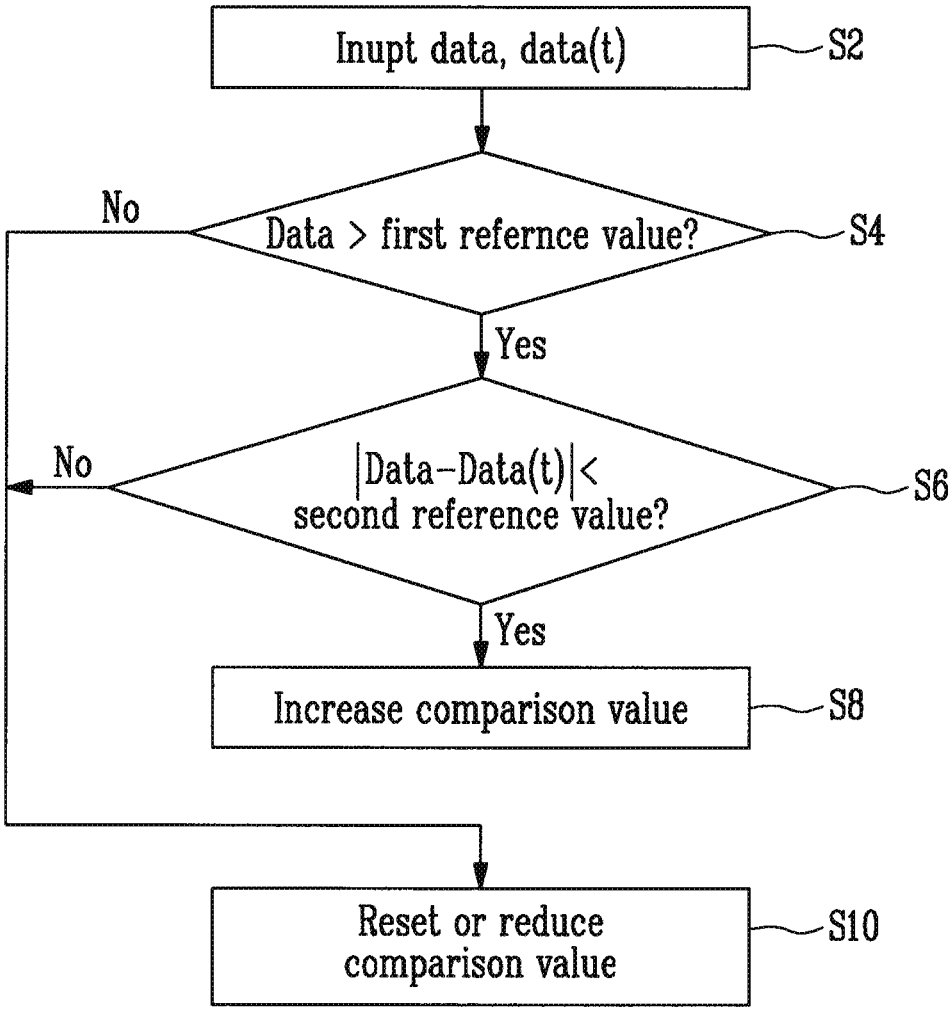
FIG. 2 is a flowchart illustrating an operation process of the data comparer shown in FIG. 1.

FIG. 2 is a flowchart illustrating an operation process of the data comparer shown in FIG. 1.

Referring to FIG. 2, the data comparer 170 receives previous data(t) from the frame memory 160 and receives current data from the outside (S2). The data comparer 170 compares the current data with a first reference value (S4). The first reference value may be selected as a gradation under ⅓ of a maximum gradation value that can be represented, for example between ⅓ and ¼. For example, when the display region 130 can represent a gradation of 1024, the first reference value may be less than 341, for example, a value between 256 and 341.

When the current data is smaller than the first reference value in S4, it is determined that burn-in may not occur due to relatively low gradation. Practically, burn-in substantially does not occur in an organic light emitting display device when black or low gradation is represented. Therefore, when the current data is smaller than the first reference value in S4, the comparison value is reset to "0" or reduced (S10). For example, when the current data is smaller than the first reference value in S4, the comparison value can be reset to "0".

When the current data is larger than the first reference value in S4, the system determines whether a difference (i.e., absolute value) between the current data Data and the previous data(t) is smaller than a second reference value (S6). The second reference value is a value for determining whether video has changed, or for example, if a particular luminance has changed more than a certain amount, and in some embodiments can be selected to be between 0 and 20, for example, 10. That is, it is checked in S6 whether the gradation of the previous data(t) and the current data has changed by 10 or more.

When the difference in gradation of the previous data(t) and the current data is less than the second reference value, it is determined that a retention image is displayed, and the comparison value is correspondingly increased (S8).

When it is determined that the difference in gradation between the previous data(t) and the current data is greater than or equal to the second reference value, the comparison value is reset to "0" or reduced (S10). For example, when it is determined that that the difference in gradation between the previous data(t) and the current data is greater than or equal to the second reference value, the comparison value may be reduced.

As described above, the data comparer 170 generates comparison values corresponding to the data stored in the frame memory 160, and transmits the generated comparison values to the control value generator 180. In this configuration, the larger the comparison value, the more the possibility that burn-in will occur.

Meanwhile, the data comparer 170 generates and transmits a reset signal to the control value generator 180 when the previous data(t) and the current data Data are sufficiently different.

Figure 3:
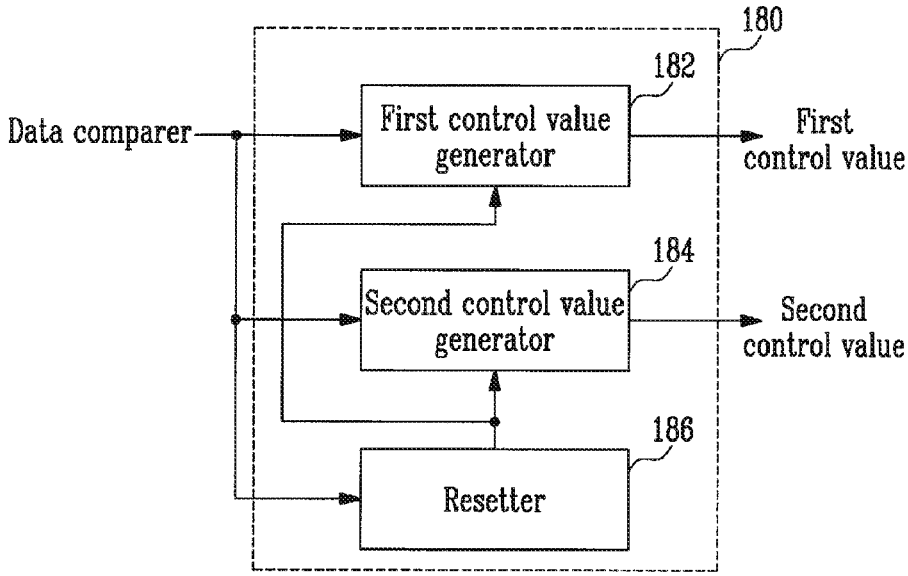
FIG. 3 is a schematic diagram showing the control value generator shown in FIG. 1.

FIG. 3 is a diagram illustrating the control value generator.

Referring to FIG. 3, the control value generator 180 includes a first control value generator 182, a second control value generator 182, and a resetter 186.

The first control value generator 182 generates a first control value using comparison values for the entire display region 130 (i.e., panel). Here, the first control value generator 182 reduces the first control value, when the comparison values for the entire display region 130 are relatively high. Further, in some embodiments, the first control value generator 182 can reduce the first control value when the comparison value at a center potion of the panel is determined to be high, and/or when the comparison values of particular regions (e.g., predetermined regions) in the entire display region 130 are determined to be high.

In detail, the first control value may be set to a value between 1 and 0. The first control value may initially be set to "1", and the first control value generator 182 controls the first control value corresponding to the comparison values.

In some embodiments, the first control value generator 182 can reduce the first control value when the comparison values are relatively high over the entire display region 130, for example, when the comparison values over the entire display region 130 is more than half of the comparison value range. Further, in some embodiments, the first control value generator 182 can reduce the first control value, for example, when the comparison values of the center portion of the panel are 20% higher than the comparison values of other regions and/or when the comparison values of a particular region of the panel is 50% higher than for other regions.

The second control value generator 184 may reduce a second control value when the comparison values of outer regions of the panel are above 50%, and/or when the comparison values of the outer regions of the display region 130 are relatively high. The second control value may be set to a value between 1 and 0. The second control value may be initially set to "1", and the second control value generator 184 controls the second control value corresponding to the comparison values.

The resetter 186 controls the first control value generator 182 and the second control value generator 184, to initialize the first control value and the second control value when a reset signal is inputted from the data comparer 170. In this case, the first control value generator 182 and the second control value generator 184 may output "1" as the first control value and the second control value, respectively.

The first control value and the second control value are used to control the luminance in embodiments of the present invention. In this case, changes in luminance may be recognizable by an observer's eyes if the first control value and the second control values changes too rapidly. Therefore, in some embodiments of the present invention, a range of change or a modification speed of the first control value and the second control value may be experimentally determined, such that luminance may be adjusted by, for example, between 1 to 0.5 nit/sec by the first control value and the second control value.

Figure 4:
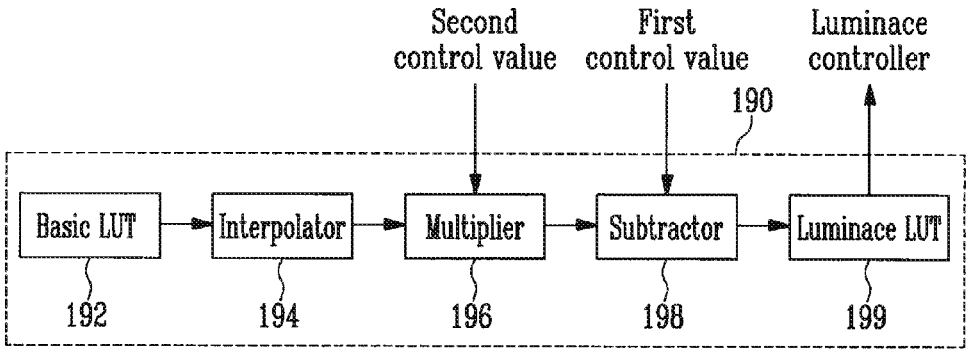
FIG. 4 is a schematic diagram illustrating the LUT generator shown in FIG. 1.
Figure 5:
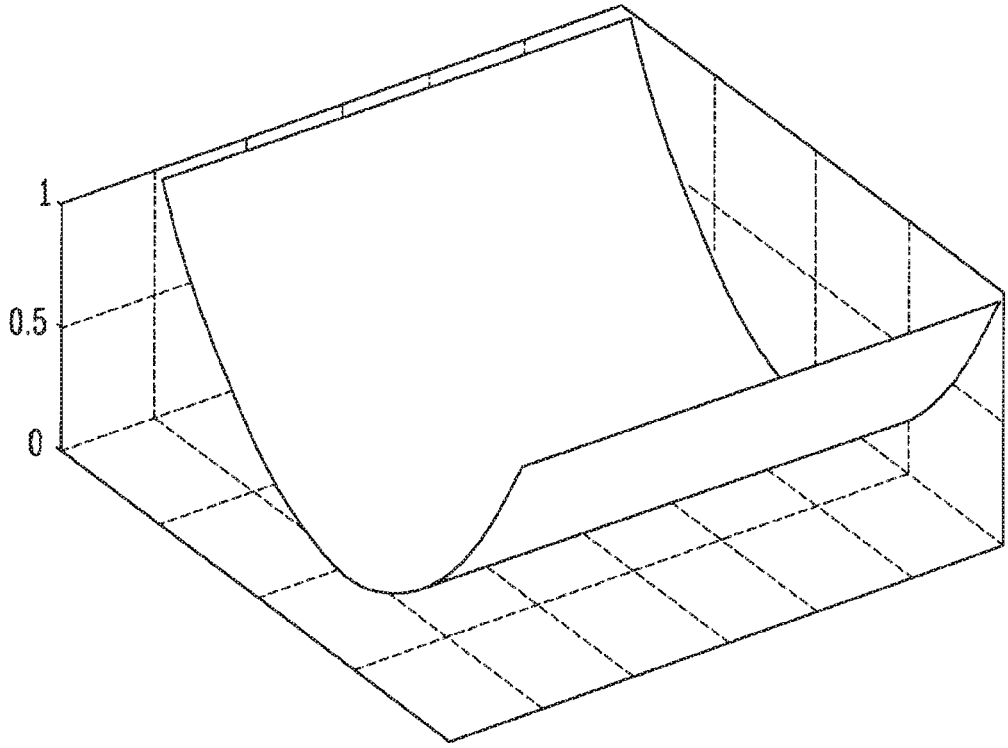
FIG. 5 is a view showing an example of the basic LUT shown in FIG. 4.

FIG. 4 is a diagram illustrating the LUT generator.

Referring to FIG. 4, the LUT generator 190 according to an embodiment of the present invention has a basic LUT 192, an interpolator 194, a multiplier 196, a subtractor 198, and a luminance LUT 199.

The basic LUT 192 may be stored in advance in the LUT generator 190 and may be set to have a burn-in value (or initial burn-in value) corresponding to, for example, relative possibility or likelihood of burn-in. For example, the basic LUT may be set such that an outer region has a value of "1" or slightly less, and center portion has a value of "0" or slightly more, as can be seen, for example, in FIG. 5.

Experimentally, when the panel of an organic light emitting display device is applied to a laptop, burn-in generally occurs more frequently at the upper portion and the lower portion of the screen, and occurs less frequently at the center portions. The basic LUT is set to have a value closer to "1" where burn-in may be more likely based on experimental results, and set to have a value closer to "0" where burn-in may be less likely, and these values may be stored in the LUT generator 190.

The basic LUT 192 may store a burn-in value corresponding to all pixels 140 included in the display region 130. Therefore, the memory capacity utilized for storing such a basic LUT 192 may be large. As such, in some embodiments of the present invention, only the burn-in information of some pixels 140 included in the display region 130 may be stored in the basic LUT 192 (e.g., burn-in value may be stored for every 8 pixels or 16 pixels).

The interpolator 194 may be utilized to obtain burn-in information for the entire panel by using the burn-in information of some pixels in the basic LUT 192 and interpolating the remaining values. Interpolation is well known in the art, and will not be described in further detail. Meanwhile, in embodiments where the basic LUT 192 includes information for all of the pixels 140 included in the display region 130, the interpolator 194 may not be provided.

The multiplier 196 generates second burn-in values by multiplying the burn-in values of the pixels supplied from the interpolator 194 (or the basic LUT 192) with the second control value.

The subtractor 198 generates third burn-in values by subtracting the second burn-in values from the first control values. The third burn-in values are stored in a memory (not shown) as luminance LUT.

For convenience of description, the operation process is described in the following example, where the first control value is "1", the second control value is "0.2", and "0.9" and "0.2" of the first burn-in value are determined for a pixel in an outer region and a pixel in a center portion, respectively, corresponding to the basic LUT 192.

The multiplier 196 generates the second burn-in value by multiplying the second control value with the first burn-in value. Therefore, when a first burn-in value of 0.9 is inputted, a second burn-in value of 0.18 is generated, and when a first burn-in value of 0.2 is inputted, a second burn-in value of 0.04 is generated.

Figure 6:
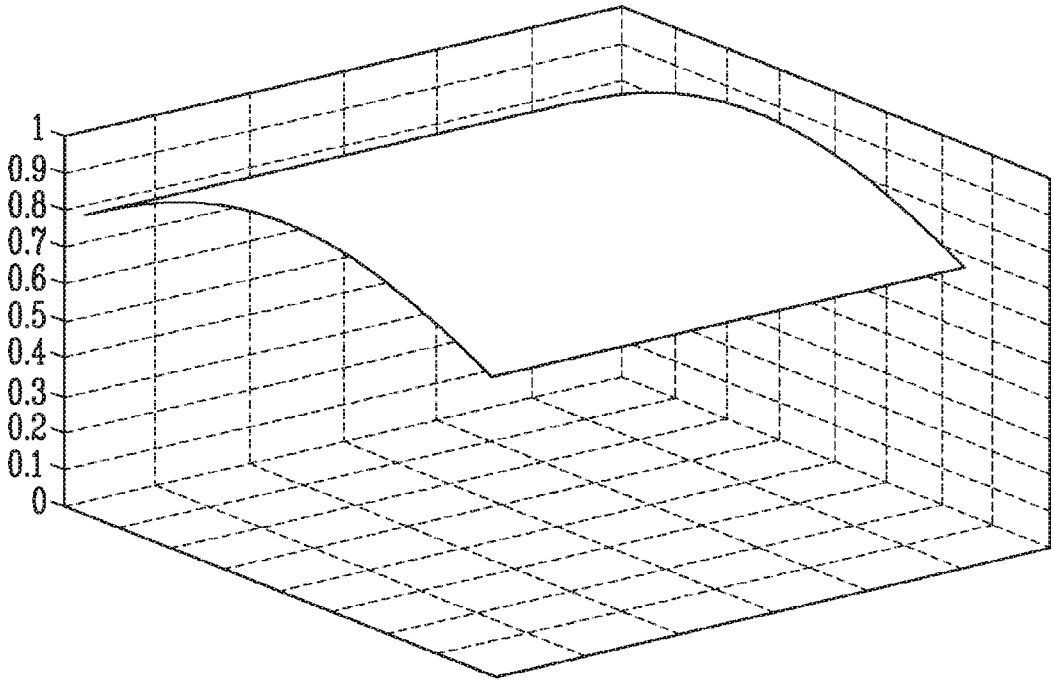
FIG. 6 is a view showing an example of the luminance LUT shown in FIG. 4.

The subtractor 198 generates third burn-in values by subtracting the second burn-in values from the first control values. Therefore, when a second burn-in value of 0.18 is inputted, a third burn-in value 0.82 is generated, and when a second burn-in value of 0.04 is inputted, a third burn-in value of 0.96 is generated. The subtractor 198 generates a luminance LUT 199, by obtaining the third burn-in values for all of the pixels. When the first control value is set to "1" and the second control value is set to "0.2", an approximate example of a luminance LUT 199 as shown in FIG. 6 may be generated.

Thereafter, the luminance controller 200 generates the output data Data' by controlling or adjusting the luminance of the input data using the third burn-in values from the luminance LUT 199. For example, the luminance controller 200 may apply a third burn-in value of 0.82 when input data for a pixel in an outer region of the display region 130 is inputted. Thereafter, the luminance controller 200 generates output data Data' by, for example, adjusting a bit value of the input data, such that the output data Data' may have a brightness corresponding to approximately 80% or 82% of the original luminance.

Further, the luminance controller 200 may apply a third burn-in value of 0.96 when input data for a pixel in a center portion of the display region 130 is inputted. Thereafter, the luminance controller 200 generates output data Data' by adjusting a bit value of the input data, such that the output data Data' may have brightness corresponding to approximately 96% of the original luminance.

As described above, embodiments of the present invention can minimize or reduce burn-in without interrupting information transmission, by reducing luminance where burn-in occurs more frequently, while keeping luminance in other portions substantially the same as an initially intended luminance.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. An organic light emitting display device, comprising:

pixels connected to corresponding scanning lines and corresponding data lines;

a scanning driver for supplying scanning signals to the scanning lines;

a data driver for supplying data signals to the data lines; and a data processor for generating a luminance look-up table corresponding to a likelihood of burn-in for the pixels, for generating output data from input data corresponding to the look-up table, and for supplying the output data to the data driver; wherein the data processor comprises:

a frame memory for storing the input data;

a data comparer for generating comparison values by comparing previous input data stored in the frame memory with current input data supplied from the outside, wherein the data comparer is configured to increase the comparison value when the current input data is larger than a first reference value or when an absolute value obtained by subtracting the previous input data from the current input data is smaller than a second reference value;

a control value generator for venerating a first control value and a second control value corresponding to the comparison values;

a look-up table generator for generating the luminance look-up table corresponding to the first control value and the second control value; and a luminance controller for generating the output data corresponding to the luminance look-up table.

2. The organic light emitting display device as claimed in claim 1, wherein the frame memory is configured to store a portion of the input data for one frame.

3. The organic light emitting display device as claimed in claim 1, wherein the frame memory is configured to store the input data for one frame.

4. The organic light emitting display device as claimed in claim 1, wherein the first reference value is a gradation value that is less than ⅓ of a maximum gradation value that can be represented by the input data.

5. The organic light emitting display device as claimed in claim 1, wherein the first reference value is a gradation value that is between ⅓ and ¼ of a maximum gradation value that can be represented by the input data.

6. The organic light emitting display device as claimed in claim 1, wherein the second reference value is a gradation value that is between 0 and 20.

7. The organic light emitting display device as claimed in claim 1, wherein the data comparer resets the comparison value when the current input data is less than or equal to the first reference value or when the absolute value obtained by subtracting the previous input data from the current input data is greater than or equal to the second reference value.

8. An organic light emitting display device, comprising:

pixels connected to corresponding scanning lines and corresponding data lines;

a scanning driver for supplying scanning signals to the scanning lines;

a data driver for supplying data signals to the data lines; and a data processor for generating a luminance look-up table corresponding to a likelihood of burn-in for the pixels, for generating output data from input data corresponding to the look-up table, and for supplying the output data to the data driver, wherein the data processor comprises:

a frame memory for storing the input data;

a data comparer for generating comparison values by comparing previous input data stored in the frame memory with current input data supplied from the outside;

a control value generator for generating a first control value and a second control value corresponding to the comparison values;

a look-up table generator for generating the luminance look-up table corresponding to the first control value and the second control value; and a luminance controller for generating the output data corresponding to the luminance look-up table;

wherein the control value generator comprises:

a first control value generator for generating the first control value by utilizing the comparison values for substantially all of the pixels;

a second control value generator for generating a second control value by utilizing comparison values for pixels corresponding to outer regions of the display device; and a resetter for initializing the first control value and the second control value when a reset signal is received from the data comparer.

9. The organic light emitting display device as claimed in claim 8, wherein the first control value generator is configured to reduce the first control value when the comparison values for substantially all of the pixels are greater than half of a comparison value range.

10. The organic light emitting display device as claimed in claim 8, wherein the first control value generator is configured to reduce the first control value when the comparison values of pixels corresponding to a center portion of the display device are 20% higher than the comparison values of pixels corresponding to other regions of the display device or when the comparison values of pixels corresponding to a second region of the of the display device are 50% higher than the pixels corresponding to the other regions of the display device.

11. The organic light emitting display device as claimed in claim 8, wherein the second control value generator is configured to reduce the second control value when the comparison values of the pixels corresponding to the outer regions of the display device are greater than the half of a comparison value range.

12. The organic light emitting display device as claimed in claim 8, wherein the first control value and the second control value are configured to be values between 1 and 0.

13. The organic light emitting display device as claimed in claim 8, wherein the resetter is configured to initialize the first control value and the second control value to 1 when the reset signal is received.

14. An organic light emitting display device, comprising:

pixels connected to corresponding scanning lines and corresponding data lines;

a scanning driver for supplying scanning signals to the scanning lines;

a data driver for supplying data signals to the data lines; and a data processor for generating a luminance look-up table corresponding to a likelihood of burn-in for the pixels, for generating output data from input data corresponding to the look-up table, and for supplying the output data to the data driver, wherein the data processor comprises:

a frame memory for storing the input data;

a data comparer for generating comparison values by comparing previous input data stored in the frame memory with current input data supplied from the outside;

a control value generator for generating a first control value and a second control value corresponding to the comparison values;

a look-up table generator for generating the luminance look-up table corresponding to the first control value and the second control value; and a luminance controller for generating the output data corresponding to the luminance look-up table;

wherein the look-up table generator comprises:

a basic look-up table for providing first burn-in values having a value between 1 and 0 corresponding to the likelihood of burn-in corresponding to a position of the pixels in the display device;

a multiplier for generating second burn-in values by multiplying the first burn-in values stored in the look-up table with the second control value; and a subtractor for generating third burn-in values by subtracting the second bum-in values from the first control value.

15. The organic light emitting display device as claimed in claim 14, wherein the third bum-in values are utilized for the luminance look-up table.

16. The organic light emitting display device as claimed in claim 14, wherein the luminance controller is configured to generate the output data corresponding to one of the pixels by multiplying the third bum-in value corresponding to the one of the pixels with the input data corresponding to the one of the pixels.

17. The organic light emitting display device as claimed in claim 14, further comprising an interpolator between the basic look-up table and the multiplier, for generating first burn-in values corresponding to all of the pixels by utilizing the first bum-in values corresponding to some of the pixels stored in the basic look-up table.

18. The organic light emitting display device as claimed in claim 14, wherein the first burn-in value of the basic look-up table is configured such that pixels having a greater likelihood of bum-in have a first burn-in value closer to 1.

19. A method of driving an organic light emitting display device, comprising:

comparing previous input data with current input data;

increasing a comparison value when the previous input data is larger than a first reference value or when an absolute value obtained by subtracting the previous input data from the current input data is smaller than a second reference value;

generating a first control value by utilizing the comparison values for substantially all of the pixels of the display device;

generating a second control value by utilizing the comparison values for pixels corresponding to outer regions of the display device;

generating a luminance look-up table by utilizing a basic look-up table including first burn-in values between 1 and 0 corresponding to a likelihood of burn-in corresponding to a position of the pixels in the display device, the first control value, and the second control value; and generating output data by changing the current input data utilizing the luminance look-up table.

20. The method of driving an organic light emitting display device as claimed in claim 19, wherein the first reference value is a gradation value that is less than ⅓ of a maximum gradation value that can be represented by the input data.

21. The method of driving an organic light emitting display device as claimed in claim 19, wherein the first reference value is a gradation value that is between ⅓ and ¼ of a maximum gradation value that can be represented by the input data.

22. The method of driving an organic light emitting display device as claimed in claim 19, wherein the second reference value is a gradation value that is between 0 and 20.

23. The method of driving an organic light emitting display device as claimed in claim 19, wherein the first control value is reduced when the comparison values for substantially all of the pixels are greater than half of a comparison value range.

24. The method of driving an organic light emitting display device as claimed in claim 19, wherein the second control value is reduced when the comparison values of the pixels corresponding to the outer regions of the display device are greater than half of a comparison value range.

25. The method of driving an organic light emitting display device as claimed in claim 19, wherein the first control value and the second control value are configured to be values between 1 and 0.

26. The method of driving an organic light emitting display device as claimed in claim 19, wherein the generating of the luminance look-up table includes:

generating second burn-in values by multiplying the first burn-in values stored in the basic look-up table with the second control value;

generating third burn-in values by subtracting the second burn-in values from the first control value; and generating the luminance look-up table with the third bum-in values.

27. The method of driving an organic light emitting display device as claimed in claim 26, wherein the output data corresponding to one of the pixels is generated by multiplying the third burn-in value corresponding to the one of the pixels with the input data corresponding to the one of the pixels.

* * * * *